US005303179A

United States Patent [19]

Kumar

[11] Patent Number: 5,303,179

[45] Date of Patent: Apr. 12, 1994

[54] METHOD AND APPARATUS FOR ELECTRONICALLY SIMULATING CAPACITORS

[75] Inventor: Lalit Kumar, Shelburne, Vt.

[73] Assignee: Simmonds Precision Products, Inc., Akron, Ohio

[21] Appl. No.: 816,274

[22] Filed: Jan. 3, 1992

[51] Int. Cl.[5] ..... G06G 7/62

[52] U.S. Cl. ..... 364/802; 328/127

[58] Field of Search ..... 364/802; 324/649, 715; 328/127; 333/213, 214

[56] References Cited

U.S. PATENT DOCUMENTS

| | | |
|---|---|---|
| 3,880,006 | 4/1975 | Poduie . |
| 3,947,675 | 3/1976 | Mayn . |
| 4,156,859 | 5/1979 | Forward et al. . |
| 4,499,552 | 2/1985 | Kanazawa . |
| 4,545,020 | 10/1985 | Brasfield . |
| 4,644,306 | 2/1987 | Kleinberg . |
| 4,678,947 | 7/1987 | Huijsing et al. . |
| 4,785,250 | 11/1988 | Lawton . |
| 4,885,528 | 12/1989 | Tanaka et al. . |
| 4,992,740 | 2/1991 | Wakasugi . |

OTHER PUBLICATIONS

Pease, Robert A., "Improve circuit performance with a 1-op-amp current pump", National Semiconductor Corp., California, date unknown.

*Primary Examiner*—Jerry Smith

*Assistant Examiner*—Jim Trammell

*Attorney, Agent, or Firm*—William E. Zitelli; Leonard L. Lewis

[57] ABSTRACT

A circuit that electronically simulates a capacitor includes a differentiator and a current source. In the preferred embodiment, the differentiator includes a differentiating gain amplifier that produces an output signal in response to an applied input signal, with the output signal being proportional to the time rate of change of the input signal. The differentiator further includes a variable inverting gain stage that produces a reference signal that has a desired phase relationship with respect to the input signal, such as a ninety degree leading phase for sinusoidal input signals. The variable gain stage is also used to provide for different simulated capacitance values, and to compensate for variations in the differentiator fixed value component. The current source is preferably a high output impedance current source such as a Howland current pump. The current source produces, in response to the reference signal from the differentiator, an output current that is proportional to the time rate of change of the input signal. The circuit also simulates dissipation factor of a capacitor in that the gain and phase response of the operational amplifiers used in the differentiator are frequency dependent. The gain stage can also be used for compensating the circuit for different applied input signal frequencies. The invention is particularly useful as a troubleshooting tool for analysis of fuel tank gauging systems.

29 Claims, 1 Drawing Sheet

METHOD AND APPARATUS FOR ELECTRONICALLY SIMULATING CAPACITORS

BACKGROUND OF THE INVENTION

The invention generally relates to electronic circuits that simulate passive circuit devices such as capacitors. More specifically, the invention relates to an electronic circuit and method for simulating a capacitor such as a fuel tank sensor capacitor.

A known technique for determining fluid levels in tanks such as aircraft fuel tanks is to place in the tank a series of capacitive sensors that have capacitance values that vary with the percentage of the capacitor plates covered by the fuel. Such systems are shown, for example, in U.S. Pat. Nos. 4,968,946 and 4,908,783 both issued to Maier. Each sensor comprises essentially a two-plate capacitor that is connected to a capacitance detection circuit. The capacitance is detected by applying a time varying voltage to the capacitor and measuring the resultant current. As is well known, the current in a capacitor is proportional to the time rate of change of the voltage across the capacitor. The proportionality constant is defined as the capacitance, C, or $I=CdV/dT$.

Because the fuel tank sensor capacitors are physically located in the aircraft fuel tanks, the capacitors are tested using test circuits that can be connected to the capacitor leads independently of the on-board electronics. The capacitors can thus be tested without the need to remove the sensors from the tanks for troubleshooting. However, failure isolation requires that technicians be able to determine that the test equipment is functional, as well as being able to check the integrity of the aircraft on-board electronics. Therefore, having access to a simulated capacitor that has a known value can provide a valuable troubleshooting tool that avoids the need to tear down the fuel tank before the exact cause of failure can be isolated.

Several factors should be considered for electronically simulating a fuel tank capacitor. For example, the circuit should simulate the fact that a capacitor functions as a high output impedance current source. This simulation may be required because the test circuits and on-board electronics may connect the capacitors to an operational amplifier virtual ground. Therefore, the simulator should provide an output current that is independent of an applied load. Another characteristic of a capacitor is that the measured capacitance is a function of the frequency of the applied excitation voltage. This characteristic results from a device parameter called the dissipation factor. The dissipation factor of a capacitor is defined as the ratio between the capacitor's equivalent series resistance and the capacitive reactance. At low excitation frequencies, for example 1 kilohertz, the dissipation factor is typically small. But as the excitation frequency increases, the dissipation factor also increases and is manifested as measuring a different value of capacitance for the device under test as compared to the lower frequency measurement. Furthermore, when the applied excitation voltage is sinusoidal, the dissipation factor can result in less than a ninety degree phase shift between the applied voltage and the resultant current.

Known attempts to simulate a capacitor electronically are not suitable for use as a fuel tank capacitor simulator. For example, U.S. Pat. No. 4,644,306 issued to Kleinberg describes a capacitor simulator that operates at high frequency and is intended to be used in an oscillator circuit. The simulated capacitor, however, apparently only provides a low impedance output from a voltage follower without simulating dissipation factor. U.S. Pat. No. 4,785,250 issued to Lawton also apparently does not provide a high output impedance and also does not simulate dissipation factor. This simulated capacitor also operates from an applied excitation current.

Accordingly, it is an object of the present invention to provide an electronic circuit and method of using the same for simulating a fuel tank sensor capacitor that utilize a high output impedance current source and that can be used to simulate dissipation factor. In a broader sense, it is an object of the present invention to provide an electronic circuit and method for simulating a capacitor that produce a current source output that is proportional to the rate of change of an applied excitation signal. Further objects of the invention are to provide an electronic capacitance simulation that can be adjusted for different values of simulated capacitors, that can be compensated for different excitation frequencies and that is insensitive to an applied load.

SUMMARY OF THE INVENTION

The instant invention contemplates an electronic circuit and method for simulating a capacitor such as a fuel tank sensor capacitor. While the invention will be described herein with particular reference to simulating a fuel tank sensor capacitor, those skilled in the art will readily appreciate that the invention can be used in many applications where a simulated capacitor is required or useful.

Such an electronic capacitance simulator includes a differentiator that has an input node connectable to an excitation input signal such as a sinusoidal voltage. According to this aspect of the invention, in the preferred embodiment, the differentiator produces a reference voltage signal that is proportional to the rate of change of the applied input voltage signal. In an alternative embodiment, the invention is realized by using a phase shift circuit that produces a reference voltage signal that leads a sinusoidal input signal by ninety degrees for a predetermined input frequency. A significant advantage of the preferred embodiment of the invention is that the circuit and method can be used with sinusoidal and non-sinusoidal input signals. The differentiator preferably includes means for adjusting the amplitude of the reference signal so that different capacitance values can be simulated. The differentiator is preferably realized using operational amplifiers having output voltages that are frequency dependent so that the invention can also be used to simulate dissipation factor.

The invention further contemplates a capacitance simulation that produces a high impedance output. According to this aspect of the invention, an electronic simulation of a capacitor uses a high output impedance current source connected to the output of the differentiator. In the preferred embodiment, the current source is realized in the form of a Howland current pump.

The invention further contemplates the methods for electronically simulating a capacitor as used in the preferred circuit embodiment. These and other aspects and advantages of the present invention will be apparent from the following detailed description of the best mode known for the preferred embodiment in view of the accompanying drawings.

DESCRIPTION OF THE PREFERRED AND ALTERNATIVE EMBODIMENTS

Figures 1, 2:
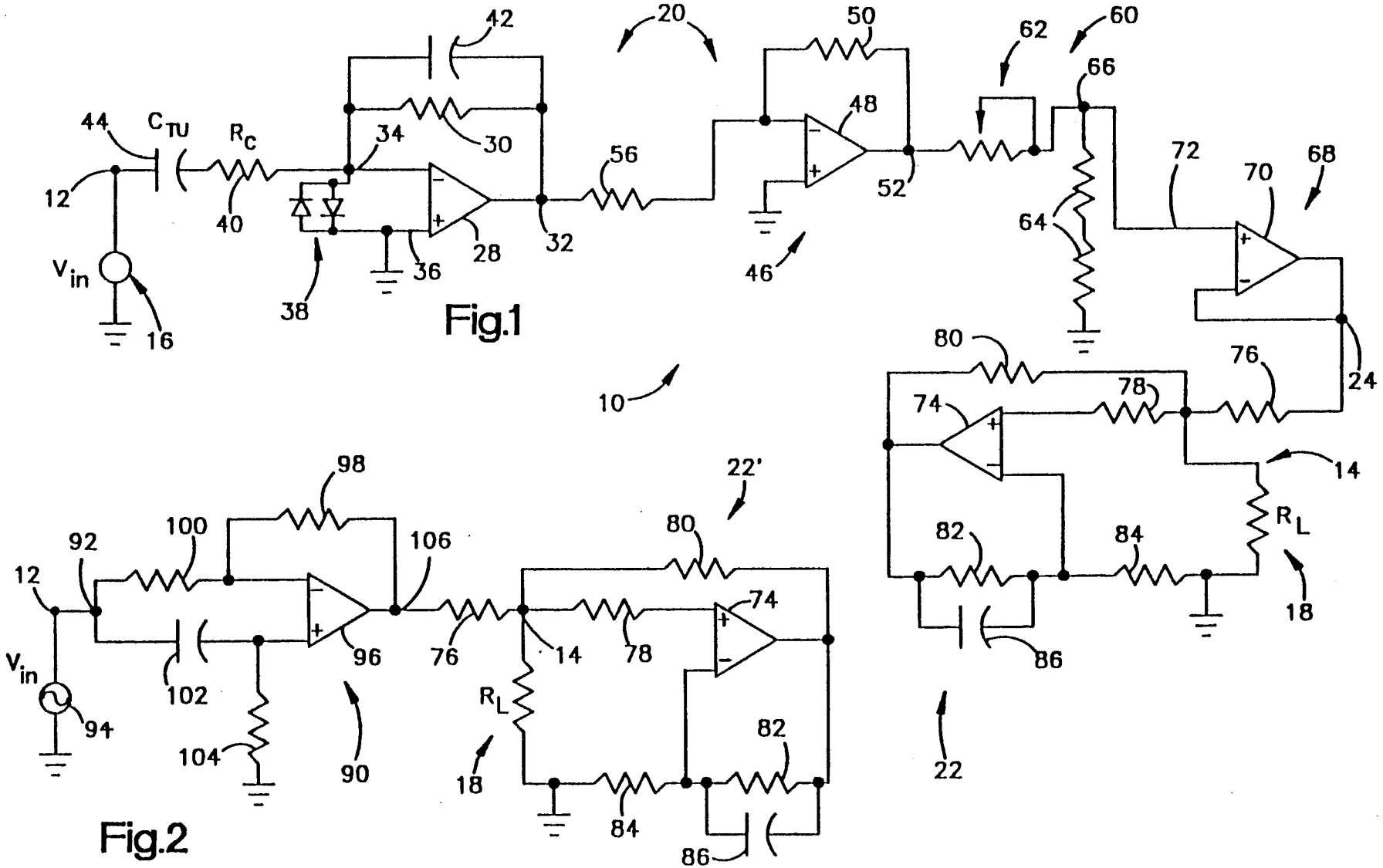
FIG. 1 is a schematic diagram of a preferred circuit for electronically simulating a capacitor according to the present invention.
FIG. 2 is a schematic diagram of an alternative embodiment of the invention.

With reference to FIG. 1, a preferred electronic circuit that embodies the invention is generally designated with the numeral 10. The circuit has an input node 12 and an output node 14. In effect, the circuit 10 electronically simulates the voltage/current characteristics of a capacitor such that, to an external circuit connected between the input and output nodes 12, 14, the circuit behaves as if only a capacitor is connected between the nodes. Furthermore, the circuit includes means for adjusting the simulated capacitance between the input and output nodes and also simulates dissipation factor. The circuit 10, therefore, can serve as a valuable troubleshooting tool. For example, the circuit can be connected to a test set that is used to check the integrity of capacitive sensors used in fuel tank gauging systems. Such systems typically apply a known time-varying input voltage signal to a capacitor and measure the resulting current. The simulated capacitor can then be used to check for proper operation of the test equipment. The simulated capacitor can also be connected to the aircraft electronics in place of the fuel tank sensors to verify proper operation of the on-board electronics. Thus, a failure can be isolated without the need to tear down a sensor system before the exact cause of failure has been determined. While the invention, and the preferred embodiment illustrated in circuit 10, is particularly useful in connection with such a fuel gauging system, it will be readily appreciated that the electronic capacitance simulator can be used in many other applications.

The input node 12 is connectable to an input signal source 16. The input signal applied to node 12 can be from any source of a time-varying signal waveform, such as, for example, a sinusoidal voltage, a triangular voltage or any other selected type of waveform. The output node 14 is connectable to a load 18. In FIG. 1 the load is generally represented by a resistor $R_L$, but this is just one example of an applied load. The particular load to which the circuit 10 is connected will depend on the specific use of the circuit. For example, when the circuit 10 is used for testing fuel gauging systems, the output node 14 may be connected to a virtual ground input of a current-to-voltage converter (not shown). In such a case the load $R_L$ appears as near zero resistance. In other applications, the load may be resistive, inductive or capacitive. The circuit 10 provides a high impedance current source output at the node 14 and thus the current output is independent of the connected load.

In general, the circuit 10 includes a differentiator circuit 20 and a current source 22. In the preferred embodiment, the current source 22 is realized in the form of a Howland current pump. The output of the Howland current pump is common with the circuit output node 14 connectable to the load $R_L$. The differentiator 20 preferably includes several subcircuits as will be described herein. The differentiator 20 produces an output reference signal at a node 24 that is connected to the current source 22 input.

The differentiator 20 includes a differentiating gain amplifier circuit 26 that includes an operational amplifier 28 configured as an inverting negative feedback gain amplifier. Thus, the differentiating circuit 26 includes a feedback resistor 30 connected between an amplifier output 32 and an inverting input 34 of the amplifier 28. The amplifier non-inverting input 36 is connected to ground or reference potential. A pair of parallel diodes 38 with opposite polarity may be connected between the inverting and non-inverting inputs 34,36 of the amplifier 28 to protect the amplifier inputs from transients, as is well known. An input resistor 40 is connected at one end to the inverting input of the amplifier 28 to stabilize the feedback loop in the circuit 26. A feedback capacitor 42 may also be provided to improve the stability of the circuit 26.

The input resistor 40 is also connected to an input reference capacitor 44. The reference capacitor is connected to the input resistor 40 and the input node 12. The reference capacitor 44 is labelled $C_{TU}$ in FIG. 1 because, in the exemplary application being described herein, a fuel tank sensor typically includes a reference capacitor that has a value independent of the fuel level in the tank. Thus, the tank reference capacitor can serve as the input reference capacitor; or preferably the circuit 10 can be provided with a permanent reference capacitor 44 that has a value close to the expected value of the tank reference capacitor. However, it is important to keep in mind that the value of the simulated capacitance of the circuit 10 is preferably independent of the value of the reference capacitor 44.

By connecting the reference capacitor 44 in series between the input signal source 16 and the inverting input of the amplifier 28, the amplifier functions so as to differentiate the input signal. When a voltage is applied at the input node 12, the reference capacitor 44 current $I_c$ is proportional to the time rate of change of the applied input signal according to the equation $I_c = -C_{TU}dV/dT$. This current produces a voltage across the input resistor 40. The amplifier 28 produces an output voltage across the feedback resistor 30 that is proportional to the product of the feedback resistor 30 and the reference capacitor 44, and is also proportional to the time rate of change of the input signal applied at the input node 12. That is, the output voltage is closely approximated by the equation $V = R_c C_{TU} dV_{IN}/dt$ and the differentiator gain is defined by the ratio $R30/X_{CTU}$.

For example, if the input signal is sinusoidal, the output from the differentiating amplifier 26 is cosinusoidal or ninety degrees phase shifted with respect to the input signal. If the input signal is a linear ramp voltage, then the differentiating amplifier 26 output is a DC voltage. Thus, the differentiating circuit 26 provides the fundamental capacitor simulation of producing a signal that is proportional to the time rate of change of an input voltage signal.

Because the differentiating amplifier circuit 26 uses an operational amplifier that is configured as an inverting gain amplifier, the amplifier output at node 32 is actually 180 degrees, or in other words inverted, from the desired signal that would be obtained from an actual capacitor. Therefore, the differentiator 20 also includes an inverting gain stage amplifier circuit 46. The gain stage circuit 46 includes an operational amplifier 48 that is again configured as a negative feedback gain amplifier. The gain stage 46 includes a feedback resistor 50 connected between an output 52 and an inverting input 54 of the operational amplifier 48. The gain stage 46 also includes an input resistor 56 such that the voltage gain of the circuit 46 is defined by the ratio of the feedback resistor 50 to the input resistor 56. The non-inverting input 58 of the amplifier 48 is connected to ground.

The gain stage 46 inverts the output signal from the differentiating amplifier circuit 26, such that the output from the inverting gain stage 46 produced at an output node 52 has the desired capacitance-simulated phase relationship to the input signal applied at the input node 12.

The combination of the differentiating circuit 26 and the inverting gain stage 46 produces a signal at the node 52 that is proportional to the time rate of change of the input signal. The gain stage 46 also provides a means for adjusting the gain of this differentiated signal so that the proportionality of the differentiated signal to the input signal corresponds to the desired simulated capacitance value. However, typically fixed resistors are used for the input and feedback resistors 40, 30, 56 and 50 resulting in the amplifiers 26 and 46 have a fixed DC gain. In order to provide for an adjustable simulated capacitance, a resistive voltage divider circuit 60 is provided in the gain stage 46 that includes an adjustable potentiometer 62 and one or more fixed reference resistors 64. The voltage divider operates in a conventional manner such that the voltage at the junction node 66 is proportional to the voltage produced at the output node 52 from the amplifier 48. Thus, a designer can select the values of the fixed resistors 40, 30, 56, 50, and 64 to set approximately the desired overall gain of the differentiating and gain stages 26, 46 for the desired simulated capacitance value, and then can provide the potentiometer 62 for more precise setting of the final output gain level. Other types of amplitude gain adjustment circuits, of course, could also be used.

The circuit 10 further includes a non-inverting gain amplifier stage 68 that functions as a buffer between the voltage divider 60 and the current source 22. The buffer stage 68 is realized in the form of an operational amplifier 70 configured as a non-inverting unity-gain amplifier. Accordingly, the non-inverting input 72 is connected to the voltage divider junction node 66 and the inverting input is connected to the amplifier output 24. Alternatively, the buffer stage 68 can also include gain by providing an input resistor and feedback resistor in a known manner. It is preferred to include the buffer circuit 68 between the voltage divider 60 and the current source 22 so that the current source does not have a loading effect on the voltage divider circuit 60. Also, the buffer 68 provides a low impedance voltage source for driving the input of the current source 22.

Thus, the differentiator circuit 20 produces a reference signal at the buffer output node 24 that is proportional to the time rate of change of the input signal applied to the input node 12. The gain of the differentiator circuit 20 can be adjusted by appropriate selection of the fixed resistors and with the potentiometer 62 so as to simulate different capacitance values, with the advantage that the simulated capacitance is independent of the reference capacitor 44 value.

In order to realize a true capacitor simulator, the current source 22 is used to convert the reference signal produced at the buffer output node 24 to a current that is independent of the applied load $R_L$. Such a current preferably is supplied by a high output impedance current cource, such as the Howland current pump illustrated in FIG. 1. The Howland current pump shown is a conventional design having an operational amplifier 74 utilizing positive feedback to raise the output impedance of the circuit. Such a circuit is explained in the article "Improve Circuit Performance With a 1 Op-amp Current Pump" by Pease, submitted herewith, and which is fully incorporated herein by reference.

The output current produced by the Howland current pump 22 equals the reference signal produced at the buffer output node 24 divided by an input resistor 76. The input resistor 76 is connected between the reference signal node 24 and the simulator circuit output node 14. The remaining resistors and capacitor, identified by the numerals 78, 80, 82, 84 and 86, are selected at appropriate for the deesired configuration of the Howland current pump and desired output current drive. At the end of this specification is a table listing all of the components along with typical values or component types that can be used to realize the circuits in FIGS. 1 and 2.

Operation of the circuit 10 is as follows. The input signal, such as for example, a sinusoidal waveform, is applied to the input terminal or node 12. This signal is differentiated by the differentiating circuit 26, the output of which at node 32 is then inverted with a desired gain factor by the inverting gain stage 46. The voltage divider circuit 60 can be further used to adjust the overall differentiator gain so that the reference signal output at the buffer node 24 is proportional to the time rate of change of the input signal; with the proportionality constant, of course, corresponding to the desired simulated capacitance value. For example, when the input signal is sinusoidal, the reference signal at node 24 leads the input signal by a ninety degrees phase difference. The Howland current pump 22 then converts the refernce signal toa current from a high output impedance source such that the output current at the circuit output node 14 leads the input signal by the same ninety degrees. The output current from the high impedance current pump 22 is independent of the applied load.

One of the important advantages of the invention as realized in a circuit such as shown in FIG. 1 is that the circuit not only simulates the current/voltage/phase characteristics of a capacitor but also simulates dissipation factor. Dissipation factor relates to a characteristic of a capacitor that is frequency dependent. The dissipation factor is defined as the ratio of the equivalent series resistance to the reactive impedance. Thus, the dissipation factor for a capacitor is a function of the frequency of the applied excitation voltage, and is manifested by the fact that the measured value of a capacitor depends on the frequency of the applied excitation or test signal. Dissipation factor also can be manifested by a loss of phase shift between the capacitor current and applied voltage. Thus, in an ideal capacitor, the current leads the voltage across the capacitor by ninety degrees. But, the dissipation factor increases for a capacitor with frequency, such that at higher frequencies the current may not lead the voltage by exactly ninety degrees.

The instant invention simulates dissipation factor by virtue of the fact that the differential amplifier circuits 26 and 46 are frequency dependent. In other words, the gain of those circuits as well as the phase relationship between output and input changes as the frequency of the applied input signal changes. More specifically, as the frequency of the input signal applied at the input node 12 increases, the gain bandwidth of the differentiating amplifier 28 falls off so that the simulated capacitance value also decreases. The phase shift through the circuit 26 also necessarilly changes. The reference capacitor $C_{TU}$ also, of course, exhibits a dissipation factor effect.

In the described example of using the invention with a fuel gauging system, different systems may use different signal frequencies for determining the capacitance of the sensors. For example, one system may use an excitation frequency of 400 hertz, but a more common frequency is 6 kilohertz. This broad range can result in different gain and phase characteristics from the differentiating amplifier 28. The adjustable gain stage 46 including the voltage divider 62 can be used to compensate the circuit 10 for changes in frequency of the input signal applied at the input node 12 so that a desired capacitance can be simulated. The adjustable gain stage 46, of course, can also be used to compensate for variations and changes in the component values in the differentiating circuit 20 and the gain amplifier 48.

As taught by the invention then, the circuit 10, from input node 12 to output node 14, appears to function as a true capacitor in that it produces a current from a high impedance source that is proportional to the time rate of change of the applied input voltage signal. The simulated capacitance is frequency dependent, and the dissipation factor can also be simulated.

In a typical fuel tank sensor application, the circuit 10 has been used to simulate capacitance values ranging from 1 picofarad to 8000 picofarad, however, other simulated values can be achieved by appropriate selection of the individual components of the circuit 10. Also, it should be appreciated that the inverting variable gain stage 46 is primarily provided as a convenience for selecting the desired simulated capacitance, and to establish the correct phase relationship between the output current and the input signal. The phase inversion accomplished by the gain stage 46 could alternatively be accomplished with an inversion circuit that receives the current from the current source 22 (not shown) and inverts the current signal prior to applying the signal to the load.

FIG. 2 illustrates an alternative embodiment for sinusoidal excitation signals. This circuit includes a phase shift circuit 90 connected to an input node 92. The input node 22 is connectable to a sinusoidal voltage supply 94. The circuit 90 includes an operational amplifier 96 configured in a conventional manner as a phase shift circuit, and therefore includes a feedback resistor 98, an input resistor 100, an input capacitor 102, and a bias resistor 104. The amplifier 96 provides a low-impedance voltage source such that the phase-shift circuit 90 produces a reference signal at an output node 106 of the amplifier 96 that has a leading ninety degree phase shift with respect to the applied input signal. Thus, with respect to sinusoidal input signals, the phase shift circuit 90 functions as a differentiator. The reference signal at the node 106 is then applied as an input to a current source 22' in a manner similar to the circuit in FIG. 1. Thus, the current source 22' can be realized with a Howland current pump configuration similar to the circuit in FIG. 1. The circuit of FIG. 2 provides a ninety degrees phase shift for a specific applied input signal frequency. A gain adjustment stage similar to the gain circuit 46 in FIG. 1 could also be included for selecting different simulated capacitance values.

The invention also contemplates the method of electronically simulating a capacitor as described hereinabove in connection with the explanation of the preferred and alternative embodiments. Such a method generally includes the steps of differentiating an applied input signal to generate a reference signal that is proportional to the time rate of change of the input signal, and generating an output current in response to the reference signal, the output current being produced by a high impedance current source.

While the invention has been shown and described with respect to specific embodiments thereof, this is for the purpose of illustration rather than limitation, and other variations and modifications of the specific embodiments herein shown and described will be apparent to those skilled in the art within the intended spirit and scope of the invention as set forth in the appended claims.

EXEMPLARY TABLE OF COMPONENT VALUES

| Part Description | Reference Designation | Value (TYP) |
|---|---|---|
| Capacitor | 44 | 200 PF |
| Resistor | 40 | 1.69KΩ |
| Diode | D1, D2 (38) | 1N4148 |
| OP AMP | 28, 48, 70, 74, 96 | (National Semiconductor LF156) |
| Capacitor | 42 | 27 PF |
| Resistor | 30 | 4.53KΩ |
| Resistor | 56,67 | 1KΩ |
| Resistor | 50 | 24.3KΩ |
| Resistor | 69 | 3KΩ |
| Resistor | 76, 80, 82, 84 | 100KΩ |
| Resistor | $R_L$ | 1KΩ |
| Capacitor | 86 | 27 PF |
| Resistor | 64 | 5K |
| Resistor | 98,100 | 20K |
| Resistor | 104 | 11.7K |
| Capacitor | 102 | 2200 PF |

I claim:

1. A circuit that electronically simulates a capacitor such as a fuel tank capacitor comprising a first node connectable to an input signal, an output node connectable to a load, a differentiator that produces in response to said input signal an output signal proportional to rate of change of said input signal, and a high impedance current source that produces in response to said differentiator output signal an output node current having a capacitance-simulated amplitude and phase with respect to said input signal.

2. The circuit according to claim 1 wherein said current source is a Howland current pump.

3. The circuit according to claim 1 wherein said differentiator includes an adjustable gain stage having an output connected to said current source, said adjustable gain stage including means to adjust simulated capacitance values.

4. The circuit according to claim 3 wherein said gain stage includes an inverting amplifier and an adjustable voltage divider.

5. The circuit according to claim 1 wherein said differentiator produces a frequency dependent output signal having phase and amplitude characteristics that change in response to changes in said input signal frequency such that the circuit simulates dissipation factor.

6. The circuit according to claim 1 wherein said input signal is a sinusoidal voltage and said differentiator output signal is a sinusoidal voltage that is ninety degrees phase shifted with respect to said input voltage at predetermined input signal frequencies.

7. The circuit according to claim 5 wherein said current source is a voltage responsive current source such as a Howland current pump.

8. The circuit according to claim 1 wherein said input signal is a non-sinusoidal voltage.

9. The circuit according to claim 5 wherein said differentiator includes an operational amplifier configured as a negative feedback gain amplifier with an input reference capacitor connected between said input node and an inverting input of said operational amplifier.

10. The circuit according to claim 9 wherein the circuit simulates a capacitance that is independent of the value of said reference capacitor.

11. The circuit according to claim 10 wherein said differentiator further includes an inverting gain stage that receives said operational amplifier output signal and includes means for producing an output signal that is proportional to amplitude of said operational amplifier output signal, said gain stage output signal being connected as an input to said current source.

12. The circuit according to claim 11 wherein said gain stage includes an inventing gain amplifier and an adjustable voltage divider.

13. The circuit according to claim 12 wherein said gain stage further includes a non-inverting buffer connected between said voltage divider and said current source input.

14. An electronic capacitance simulator comprising an input node connectable to an input signal, an output node connectable to a load, means for producing a reference signal by differentiating said input signal, and means for providing an output current to a load in response to said reference signal, said output current with a high impedance source being proportional to rate of change of said input signal such that the simulator functions like a capacitor between said input and output nodes.

15. The capacitance simulator according to claim 14 wherein said output current is independent of the load connectable to said output node and said means for providing a reference voltage simulates dissipation factor by generating an input signal frequency dependent reference signal.

16. The capacitance simulator according to claim 15 wherein said means for providing an output current is a Howland current pump responsive to said reference signal.

17. The capacitance simulator according to claim 15 wherein said means for producing a reference signal includes an operational amplifier configured as a negative feedback differentiator having a reference capacitor connected between said input node and an inverting input of said operational amplifier.

18. The capacitance simulator according to claim 17 wherein said means for producing a reference signal further includes means for adjusting amplitude of said reference signal to compensate for component variations in said differentiator.

19. The capacitance simulator according to claim 18 wherein said means for adjusting includes an inverting gain stage with a potentiometer for adjusting amplitude of said reference signal applied to said means for providing an output current.

20. The capacitance simulator according to claim 14 wherein said means for producing a reference signal has gain and phase characteristics that are dependent on said input signal frequency to simulate dissipation factor.

21. The capacitance simulator according to claim 20 further comprising means for adjusting amplitude of said reference signal to compensate for changes in said reference signal caused by simulation of dissipation factor, wherein said means for adjusting amplitude of said reference signal produces a gain-adjusted reference signal that is provided as an input to said means for providing an output current.

22. The capacitance simulator according to claim 21 wherein said means for adjusting amplitude of said reference signal includes a gain amplifier and an adjustable voltage divider.

23. The capacitance simulator according to claim 22 wherein said input signal is a voltage signal applied to said input node, said reference signal is an output voltage from a low impedance voltage source and corresponds to a signal obtained by differentiating said input signal and is applied to said means for providing an output current such as a Howland current pump.

24. The capacitance simulator according to claim 14 wherein said input signal is a sinusoidal voltage and said output current is a sinusoidal current that leads said input voltage by ninety degrees at predetermined input signal frequencies and is proportional to rate of change of said input voltage by an adjustable simulated-capacitance value.

25. The capacitance simulator according to claim 24 in combination with a fuel tank capacitive sensor system such that the simulator is used to simulate a fuel tank capacitor.

26. A method for electronically simulating a capacitor comprising the following steps:

a. applying an input signal to an input node of a differentiator;

b. generating a reference signal by differentiating said input signal; and c. generating with a high impedance an output current for a load in response to said reference signal such that the output current is proportional to the rate of change of said input signal.

27. The method according to claim 26 wherein the step of generating a reference signal is accomplished using an operational amplifier configured as a differentiator having a reference capacitor connected between the input node and an inverting input of the operational amplifier, and the step of generating an output current is accomplished by using a Howland current pump that is responsive to said reference signal.

28. The method according to claim 27 wherein the step of generating a reference signal includes the step of adjusting the amplitude of the reference signal to simulate different capacitance values and dissipation factor.

29. The method according to claim 28 wherein the step of adjusting the amplitude of the reference signal is accomplished using an inverting gain amplifier and an adjustable voltage divider connected between the differentiator operational amplifier and the current pump.

* * * * *